343-872 SR

1/9/79 XR 4,134,121

United States Patent [19]

Northcutt

[11] 4,134,121

[45] Jan. 9, 1979

[54] SECURITY COVER FOR TRUNK AND ROOF MOUNTED ANTENNA

[76] Inventor: William Northcutt, 1001 Alcazar, Albuquerque, N. Mex. 87110

[21] Appl. No.: 861,681

[22] Filed: Dec. 19, 1977

[51] Int. Cl.[2] ..... H01Q 1/42

[52] U.S. Cl. ..... 343/715; 343/872

[58] Field of Search ..... 343/715, 872, 900; 248/534, 539

[56] References Cited

U.S. PATENT DOCUMENTS

| | | | |
|---|---|---|---|
| 3,442,476 | 5/1969 | Trimble | 343/872 |
| 4,087,819 | 5/1978 | Dalrymple | 343/715 |

*Primary Examiner*—Eli Lieberman

*Attorney, Agent, or Firm*—Walter R. Keller

[57] ABSTRACT

A security cover consisting of a mounting bracket, a base cover, a main body, and a swivel section. A plastic or rubber mounting pad protects the paint on the vehicle, and a coil spring between the base cover and main body allows for heighth variations in the antenna base.

3 Claims, 8 Drawing Figures

SECURITY COVER FOR TRUNK AND ROOF MOUNTED ANTENNA

BACKGROUND

1. Field of the Invention

This invention relates primarily with automobile trunk mounted radio antenna, and roof mounted radio antenna for automobiles and trucks. The device is particularly designed to be used in association with a clip mounted antenna which is secured to the trunk lid of an automobile, or to antenna bolted to and through a roof of an automobile or truck. The invention secures the antenna and its base to the vehicle. A secondary function is covering and protecting the antenna mount and base from dust, dirt and the elements.

2. Description of Prior Art

In recent years automobile radios and in particular, CB's have become exceedingly popular. The installation of a second radio in automobiles in ordinarily accomplished by mounting an auxiliary, whip-type antenna on the bumper, roof, or trunk lid of the vehicle. The device of this invention is designed to be utilized in conjunction with trunk lid type or roof type antenna mounts. The trunk lid type antenna mount clips on to the edge of the trunk lid, while the roof mount bolts through the roof of the vehicle. Theft of the antenna has become a particular problem for the owners, so much so that it is almost standard practice to remove the antenna and secure it in the trunk of the vehicle whenever the vehicle is left unattended. DOLLE, U.S. Pat. No. 4,028,706 provides a partial solution to the problem by locking antenna bases and insulators.

SUMMARY OF THE INVENTION

The device of this invention is primarily designed to be constructed of injection-mold plastic components. A wide variety of molding techniques are acceptable as well as various plastic materials. The devise of this invention constitutes a mounting bracket, a base cover, a main body, a swivel section, a mounting pad, and a coil spring. The mounting bracket and coil spring are to be constructed of metal, the mounting pad is of a resilient material such as rubber or suitable plastic. The remaining major parts are to be made of injection-molded plastic. The mounting bracket supports and secures the remaining components to the trunk lid, and the mounting pad provides protection for the finish of the vehicle and also minimizes noises and rattles. The base cover is generally conical in shape providing a surface difficult to grasp with a wrench or tool. The main body is generally cylindrical and is free to turn, so that it cannot be removed. The swivel section connects to the main body by over lapping spherical surfaces, a sort of ball-joint. The swivel section is free to turn also, and the ball-joint permits the antenna to deflect as the whip antenna deflects. The main body connects slidably with the base cover with the coil spring in between so that the invention is adaptable to various sized and heights of antenna bases and insulators.

DESCRIPTION OF THE PREFERRED EMBODIMENT

Figure 1:
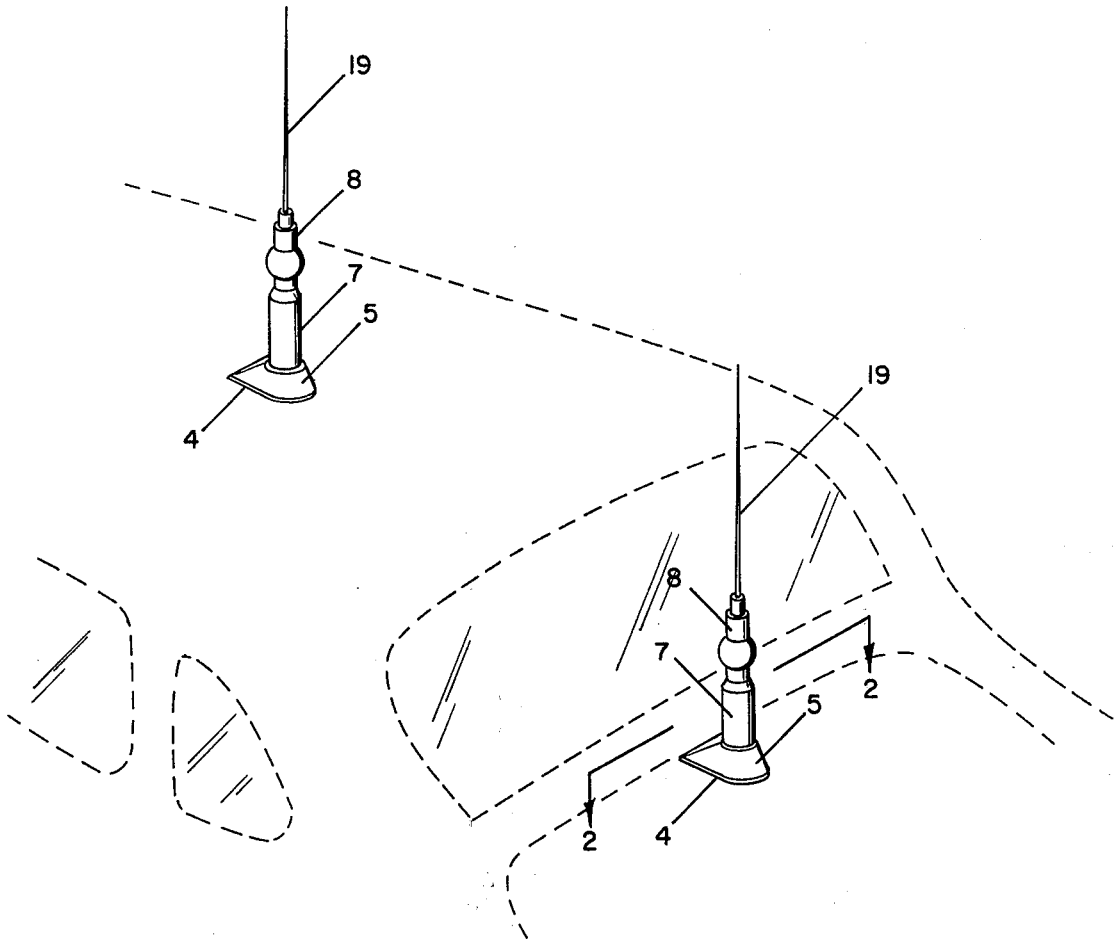
FIG. 1 is a composite view of the security cover complete with a CB antenna schematically mounted on an automobile trunk lid; and a composite view of the security cover complete with a CB antenna schematically mounted on an automobile roof.
Figure 2:
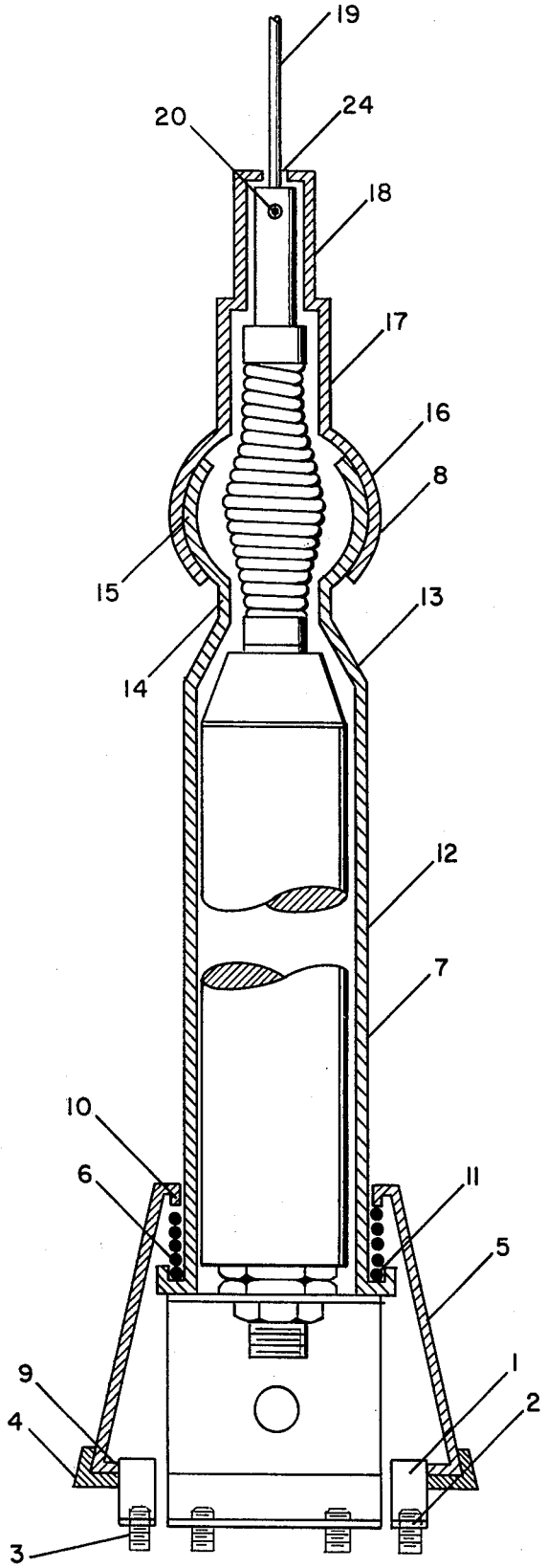
FIG. 2 is a sectional view of as cut on 2—2 in FIG. 1.
Figure 6:
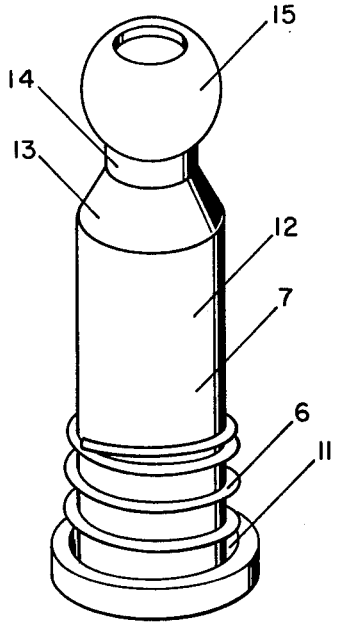
FIG. 6 is a perspective view of the main body with coil spring.
Figure 5:
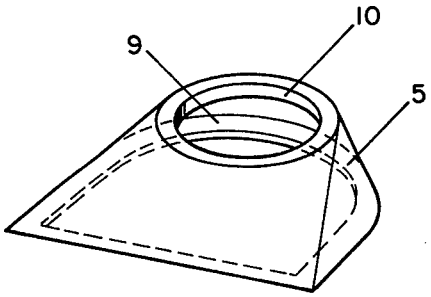
FIG. 5 is a perspective view of the base cover.
Figure 3:
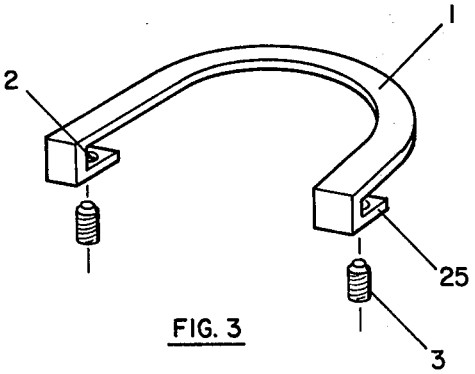
FIG. 3 is a perspective view of the mounting bracket for a trunk lid mount.
Figure 4:
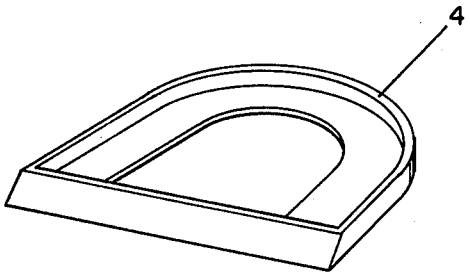
FIG. 4 is a perspective view of the trunk lid mounting pad.

FIG. 1 shows the invention installed on a trunk mounted antenna 19, and installed on a roof mounted antenna 19. On a trunk lid installation, the invention as shown in FIG. 2 consists of a mounting bracket 1 having a plurality of set-screw holes 2 and set screws 3 for securing the bracket 1 to the trunk lid, a mounting pad 4, a base cover 5, a coil spring 6, a main body 7, and a swivel section 8. The mounting bracket 1 for a trunk lid installation is made of metal in the general shape of a horseshoe, with hooks 25 having a plurality of screw holes 2 for set screws 3. The mounting pad 4, made of a resilient material such as rubber, is installed between the mounting bracket 1 and the outer surface of the trunk lid, and provides protection marring or scratching the finish of the trunk lid, and in addition the mounting pad 4 provides a means for reducing noise and or rattles. The mounting pad 4 is also shaped generally as a horseshoe as shown in FIG. 4 having a recess on which the base cover 5 and mounting bracket 1 set. The base cover 5, the main body 7 and swivel section 8, are made of a hard plastic material such as, but not limited to "Lexan" available through General Electric 1, Plastics Avenue, Pittsfield, Mass. 01201. The base cover 5, shown in FIG. 5, is generally shaped as a hollow truncated cone, having a lip 9 around the bottom of the cone such that the lip 9 snaps under the mounting bracket 1, but on top of the mounting pad 4. The base cover 5 has integrally formed at the truncation of the cone a spring ring 10 upon which the coil spring 6 bears. The base cover 5 has a circular opening in its top sized to slidably accepted the main body 7. FIG. 6 shows the main body 7 having at its bottom a spring recess 11, a cylindrical center section 12, a conical section 13, and a connecting smaller cylindrical section 14, and a spherical top 15. The main body 7 is hollow as shown in FIG. 2.

Figure 7:
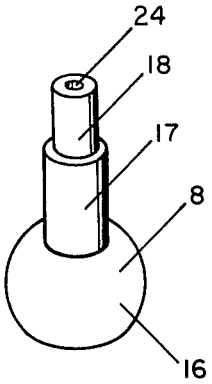
FIG. 7 is a perspective view of the swivel section.

FIG. 7 shows the swivel section 8 to have a spherical base 16, and an intermediate cylindrical section 17 connecting the spherical base 16 with a top cylindrical section 18. The top cylindrical section has an antenna hole 24 through which the antenna 19 passes. The swivel section 8 is made separately from the main body 7, but put together during manufacture so that the spherical base 16 of the swivel section 8, is permanently and rotatably over the spherical top 15 of the main body 7 forming a ball-joint as shown in FIG. 2. The coil spring 6 is made of standard material such as spring steel. The coil spring 6 is then slid over the swivel section 8 and main body 7 so that it rests in the spring recess 11. The base cover 5 is then slid down over the swivel section 8 and the main body 7 so that the springing 10 of the base cover 5 bears on the coil spring 6.

To install the invention on an antenna 19, trunk lid installation, the antenna 19 is removed by loosening an Allen wrench set screw 20, and the assembly consisting of the swivel section 8, main body 7, coil spring 6, and base cover 5 are slid up the antenna 19. The antenna 19 is then reinstalled and the Allen wrench set screw 20 tightened. The mounting bracket 1 and mounting pad 4 are installed loosely on the trunk lid, and the aforesaid assembly slid down over the antenna 19, mated to the mounting bracket 1 which is then securely positioned by tightening the set screws 3. After installation the swivel section 8 is free to revolve on the main body 7 providing accommodation for deflection of the antenna 19 and if gripped for unscrewing will turn without unloosing anything. Access to the Allen wrench set screw 20 is precluded thus securing the antenna 19. Likewise, the main body 7 is free to turn without exposing any of the antenna 19, or decreasing the security of the system. Anti-theft protection is provided in the base cover 5 by its conical shape which inhibits gripping with a wrench or pliers. The coil spring 6 permits the base cover 5 to slide up the main body 7, thus adjusting for a variety of antenna 19 sizes, yet remaining secure. Furthermore, the invention installed, provides protection for the antenna 19 installation from the elements and dust.

Figure 8:
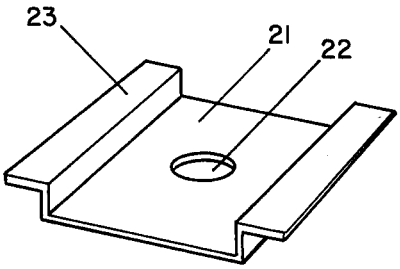
FIG. 8 is a perspective view of the mounting bracket for a roof mount.

FIG. 1 also shows a roof mounted antenna 19. FIG. 8 shows a roof mounting bracket 21, consisting of a plate having a center hole 22 and two flanges 23.

The antenna 19 on a standard roof mount, protrudes through a hole in the roof, and is secured by a nut screwed onto the antenna base on the inside of the roof. By removing the antenna 19 from its roof installation, inserting the mounting pad 4 and roof mounting bracket 21 on the outside of the roof and re-installing the antenna through the center hole 22 in the mounting bracket 21 and through the roof of the vehicle, the assembly consisting of the swivel section 8, main body 7, coil spring 6, and base cover 5 can be installed in a manner similiar to the trunk lid installation.

I claim:

1. A security cover for an antenna mounted on an automobile comprising:

a. A means for mounting the cover on the automobile, b. A mounting pad constructed of resilient material, c. A base cover which snaps onto the mounting bracket, d. A main body, which slides through a hole in base cover, having a spring recess, and having a spherical top, e. A coil spring which slides over the main body and rests on a spring recess in the main body separating the base cover from the main body, f. A swivel section having a spherical base, which rotatably mates with the spherical top of the main body, and having an intermediate cylindrical section and a top cylindrical section with an antenna hole through which the antenna passes.

2. The invention of claim 1 wherein the means for mounting the cover on a trunk lid of an automobile consists of a mounting bracket of generally horseshoe shape with hooks having a plurality of screw holes, and set screws wherein the mounting bracket hooks onto the trunk lid and is secured thereto by the set screws.

3. The invention of claim 1 whereon the means for mounting the cover on a roof installation of an automobile consists of a mounting bracket generally a flat plate with a center hole and two flanges.

* * * * *